United States Patent [19]

Arnold et al.

[11] Patent Number: 4,572,142

[45] Date of Patent: Feb. 25, 1986

[54] ARRANGEMENT FOR SUPPLYING A MAXIMUM QUANTITY OF FUEL

[75] Inventors: Herbert Arnold, Eberdingen; Michael Horbelt, Schwieberdingen, both of Fed. Rep. of Germany; Gerald Dahlke, Huntington Beach, Calif.

[73] Assignee: Robert Bosch GmbH, Stuttgart, Fed. Rep. of Germany

[21] Appl. No.: 675,458

[22] Filed: Nov. 27, 1984

Related U.S. Application Data

[63] Continuation of Ser. No. 517,356, Jul. 25, 1983, abandoned.

[30] Foreign Application Priority Data

Oct. 2, 1982 [DE] Fed. Rep. of Germany ..... 3236586

[51] Int. Cl.[4] ..... F02D 41/02

[52] U.S. Cl. ..... 123/478; 123/490

[58] Field of Search ..... 123/478, 484, 485, 490, 123/491, 179 L, 179 G, 488

[56] References Cited

U.S. PATENT DOCUMENTS

| | | | |
|---|---|---|---|
| 4,040,397 | 8/1977 | Leichele | 123/490 |
| 4,213,181 | 7/1980 | Carp et al. | 123/490 |
| 4,221,194 | 9/1980 | Wright | 123/478 |
| 4,245,590 | 1/1981 | Grozinger et al. | 123/488 |
| 4,339,781 | 7/1982 | Harsch et al. | 123/490 |
| 4,345,296 | 8/1982 | Breitting | 123/490 |
| 4,359,991 | 11/1982 | Stumpp et al. | 123/478 |
| 4,391,254 | 7/1983 | Staerzl | 123/478 |
| 4,404,846 | 9/1983 | Yamanchi et al. | 123/478 |

*Primary Examiner*—Raymond A. Nelli

*Attorney, Agent, or Firm*—Michael J. Striker

[57] ABSTRACT

A method of and arrangement for supplying a maximum quantity of fuel which is supplied to a combustion engine in certain operational conditions independent of rate of airflow and rotational speed is provided with an altitude-correcting signal which depends the maximum amount of fuel to be supplied on the air density of the actual operational altitude of the combustion engine. Through the provision of such an altitude-correction signal, a too rich mixture of fuel and air is prevented.

7 Claims, 3 Drawing Figures

ARRANGEMENT FOR SUPPLYING A MAXIMUM QUANTITY OF FUEL

This application is a continuation of application Ser. No. 517,356, filed July 25, 1983, now abandoned.

BACKGROUND OF THE INVENTION

The invention relates to a method and arrangement for supplying a maximum quantity of fuel to a combustion engine.

It is known to develop fuel injection systems including carburetors, electrically controlled carburetors, electric and mechanical fuel injectors and like systems, in such a manner that, depending on the actual operational altitude of the combustion engine above sea level, a so-called altitude correction is provided in order to correct the respectively injected amount of fuel to the combustion engine to the decreasing air density for maintaining the predetermined mixture proportions of the fuel-air mixture. Consequently, the higher the operational altitude of the combustion engine above sea level, the lower is the amount of fuel that has to be injected. Through such a provision it is prevented that a motor vehicle driving in different elevations, for example driving from a valley to higher elevations, is supplied with an increasingly rich mixture which leads to an increase of consumption and leads to problems concerning environmental protection.

In fuel injectors, so-called air volume measuring systems (air meters) are used for determining the amount of air actually supplied to the combustion engine. These air meters render necessary a correction of the amount of injection in response to decreasing air density. It is common to subject the output signal of the air meter to a preferably continuously working correction divided from an altimeter which can also be developed as an elevation sensing switch. The determined correction is based on the deviation of the measured air meter signal with respect to a theoretical value. In this case, the measured air meter signal corresponds to the theoretical value with a tolerance of about 5% per 1000 m.

In each combustion engine there are, however, operating conditions in which the supplied amount of fuel is not determined by the otherwise considered operating parameters of the combustion engine but are determined by a maximum critical value which should not be exceeded. With regard to fuel injectors, for example if electric fuel injectors are employed, this means that a separate circuit generates injection impulses of maximum duration in addition to and synchronously with the fuel injecting impulses calculated under regular conditions. The injection impulses as well as the impulses of maximum duration are combined in a gate circuit and are transmitted to a succeeding multiplication stage. This maximum impulse time limitation, i.e. the maximum amount of fuel supplied under special operating conditions to the combustion engine by the fuel injection system, is a constant value which under normal operating conditions to which also a standard operational elevation or altitude belongs has proven to be an optimum value with respect to the exhaust gas and driving quality.

The prior art system, however, has the disadvantage that the maximum value of the injected fuel amount is constant regardless of the operational altitude of the motor vehicle. Upon operation in high elevations, this leads to a too rich fuel injection and consequently to an excessively rich fuel-air mixture.

SUMMARY OF THE INVENTION

It is a general object of the present invention to avoid the disadvantages of the prior art.

In particular, it is an object of the present invention to avoid a too rich supply of the fuel when operating the motor vehicle in higher elevations.

A concomitant object of the present invention is to provide a method and arrangement for preventing excessive richness of the fuel-air mixture in a simple and economical manner.

In keeping with these objects and with others which will become apparent hereinafter, one feature of the invention resides in a method of supplying a maximum quantity of fuel to be injected to a combustion engine of a motor vehicle, which method comprises the steps of measuring a quantity of air supplied into the combustion engine, defining a maximum quantity of fuel to be supplied in dependency on load and rotary speed but independently of the measured quantity of air, determining an air density of the surrounding air, and limiting the maximum quantity of fuel to be supplied in dependence upon the determined air density.

In determining the air density of surrounding air, the instantaneous altitude of a motor vehicle above the sea level is continuously measured, so that the maximum quantity of fuel to be supplied is continuously reduced in correspondence to an increase in the measured instantaneous altitude.

According to another feature of the invention, the arrangement for determining the maximum amount of injected fuel to a combustion engine of a motor vehicle comprises means for providing a first circuit for generating an injection impulse of varying duration corresponding to the amount of fuel to be injected, means for providing a second circuit for generating an impulse corresponding to the maximum amount of fuel to be injected when the duration of the injection impulse is above a maximum value, and means for subjecting the second circuit to a correction of the impulse corresponding to the maximum amount of fuel to be injected in dependence on the surrounding air density.

Still another feature of the present invention resides in the provision of an altimeter as the means which generates a signal for cooperating with the second circuit so that the maximum amount of injected fuel is reduced depending on the altitude of the motor vehicle above sea level.

Through the provision of the inventive method and arrangement, it is possible to subject the maximum fuel supply which in a fuel injector corresponds to the longest possible duration of a separately generated injector impulse, also to an altitude correction and therefore to the actually present air density. Consequently, a too rich supply of fuel and an undesired deviation of the fuel-air mixture in direction to a rich mixture is avoided upon driving in higher elevations in which the supplied quantity of fuel is not dependent on an arbitrarily generated parameter signal. Therefore, through the method and arrangement according to the invention, the otherwise occurring excessive richness of the fuel-air mixture is prevented during operation of the combustion engine in the critical or limiting area.

Moreover, it is advantageous that the invention can be realized in a very economical manner with only a low amount of additional circuitry, because the common fuel injection systems, in case they are provided with an altitude correction, include an altimeter and thus no additional altimeter is necessary when its output signal is complementarily exploited.

The invention makes it possible to define the extent of the correction in a simple manner, wherein the invention can be used in analog form in electric fuel injectors as well as in electrically controlled carburetors.

The novel features which are considered characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENT

Figure 1:
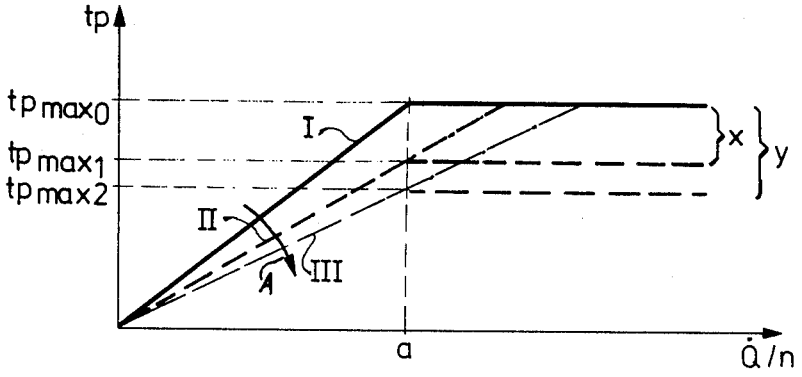
FIG. 1 is a diagram related to a fuel injector and illustrating the altitude-corrected graph of the duration of injection impulses and the limitation thereof to a maximum impulse duration which is also altitude-corrected according to the invention.

The principle of the present invention is best understood from the diagram according to FIG. 1. The different graphs I, II, III depict the amount of fuel supplied to a combustion engine in dependence on the volume Q of air drawn in relation to the rotational speed n. Referring firstly to the graph I as illustrated in full line, it can be seen that the supplied amount of fuel is linearly increasing with respect to the air volume relative to the rotational speed. It is to be noted that in the diagram of FIG. 1 the supplied amount of fuel is shown as corresponding to the duration of an injection impulse $t_p$ which is generated by a fuel injector. It is conceivable that this diagram should be understood only in a qualitative way. When a certain abscissa value a is attained, the supplied fuel amount is limited to a constant value regardless of any occurring changes of the air volume or rotational speed. Referring to a fuel injector, this means that a maximum fuel injection impulse $t_{pmaxo}$ is obtained for this critical or limiting area, whereby in this area the generation of regular fuel injection pulses $t_p$ is either turned off or both impulses $t_p$ and $t_{pmax}$ are applied to a gate circuit or to an adder where only the impulse $t_{pmax}$ becomes effective. In order to avoid an excessive richness of the fuel-air mixture supplied to the combustion engine in dependence on the respective altitude above sea level, the known altitude correction provides a flattening of the course of the graph as illustrated in FIG. 1 by the graphs II and III. The effect of increasing altitude is indicated by arrow A. The known fuel injection systems are dimensioned such that the prolongation of the graphs II and III, as illustrated by dotted lines, reaches the same maximum critical or limiting value of the amount of fuel to be supplied corresponding to the horizontal line $t_{pmaxo}$. This, however, is undesired.

By providing in accordance with this invention an altitude-corrected reduction of the maximum amount of fuel to be supplied, lower critical values of this maximum amount of fuel are obtained depending on the respective operational altitude. As can be seen in FIG. 1, additional maximum amount of fuel characterized by lines $t_{pmax1}$ and $t_{pmax2}$ are obtained which are below the line $t_{pmaxo}$ for the maximum amount of fuel relating to the sea level. Therefore, respective correcting values x and y are obtained. It is to be understood that the altitude correction of the maximum amount of fuel to be supplied can be made either continuously or in steps. Furthermore, it is to be understood that such an additionally provided altitude-corrected limitation of the maximum amount of fuel to be supplied to a combustion engine is applicable to all possible kinds of gasoline or diesel fuel injectors as well as to carburetor systems which have an arrangement for limiting the maximum amount of fuel to be supplied and which can be influenced by an altitude-correction signal in such a manner that the maximum amount of fuel to be supplied can be reduced with increasing altitudes above sea level during the operation of the motor vehicle.

Figure 2A:
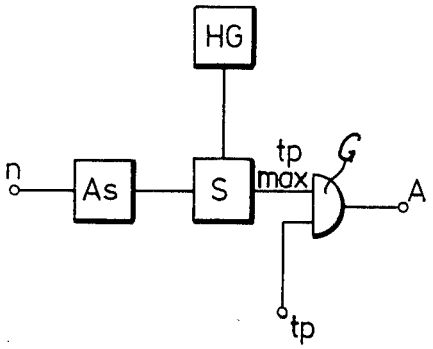
FIG. 2*a* illustrates a block diagram according to the invention.
Figure 2B:
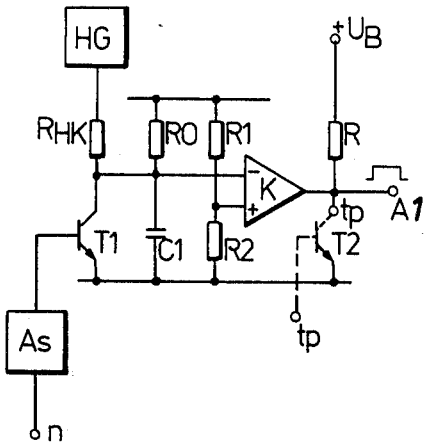
FIG. 2*b* shows a circuit according to the invention for generating maximum fuel injection impulses which are altitude-corrected.

FIGS. 2*a* and 2*b* show an embodiment specifically relating to an electric fuel injector; however, it is to be noted that the invention should not be limited to such a fuel injector.

FIG. 2*a* illustrates an impulse generating circuit S which is dimensioned in such a way that upon triggering by a speed synchronous signal an impulse of predetermined duration is provided, which impulse acts in an injector as the before mentioned $t_{pmax}$ and corresponds to the maximum amount of fuel to be supplied to a combustion engine. The circuit S can preferably be developed as a monostable multivibrator and receives triggering impulses by a trigger circuit As which is connected to the circuit S. For time-synchronizing the generation of the $t_{pmax}$ impulses by the circuit S, the received triggering impulses are either identical with the trigger impulses which cause the generation of the fuel injection impulse $t_p$ in the electric control device of the fuel injector or to generated separately and made time-synchronous to the latter trigger pulses in a suitable manner. Therefore, it is also possible to apply the $t_{pmax}$ impulses from the circuit S and the regular $t_p$ impulses to respective inputs a gate circuit G. The gate circuit G is an AND gate which produces at its output A an impulse tpmax when the regular impulse tp supplied to one input of the AND gate attains a threshold or limiting value corresponding to the value of the impulse tpmax applied to the other input of the AND gate. The input impulse tpmax which depends on altitude (barometric pressure) thus limits the other impulse tp which is a function of speed and air flow to the engine. The output A of the gate circuit is connected in this embodiment to a so-called multiplication stage of the fuel injector. By supplying the output signal of an altimeter HG to the impulse generating circuit S, a desired dependence of $t_{pmax}$=f (altitude) is obtained, and consequently the maximum amount of fuel is subjected to an altitude correction in the critical or limiting area, as illustrated in FIG. 1.

Turning now to FIG. 2*b*, which shows a detailed embodiment, there is illustrated in a simplified manner a monostable multivibrator which contains an operational amplifier connected as a comparator K. One input of the comparator K is supplied with a constant reference potential from a voltage divider consisting of resistances R1 and R2. The other input of the comparator K, which is an inverting (−) input, is connected to a series connection of a resistance Ro and a capacitor C1, and additionally via an electrical element to the outlet of an altimeter HG. The electric element can be adjustable and includes in the illustrated embodiment a resistance $R_{HK}$ for altitude correction. The voltage available at the output of the altimeter and supplied via $R_{HK}$ to the inverting input of the comparator is a measure of the actual operational altitude above sea level. Finally, the inverting input of the comparator is connected to the collector of a trigger transistor T1 whose base is connected with the triggering circuit As and is supplied by the triggering impulses which are time-synchronous with the $t_p$ impulses.

The circuit of FIG. 2*b* is completed by a transistor T2 which is connected between ground and output connection A1 of the multivibrator or comparator K. The transistor T2 can also be an end stage transistor provided in the electric control device for generating the injection impulses, and thus is shown in the circuit according to FIG. 2*b* only in dotted lines. The output of the comparator K is connected via a resistance R to a positive voltage $U_B$.

After having described the individual parts of the circuit, the mode of operation will now be explained. It is to be noted that the input of the transistor T1 can receive for triggering also the $t_p$ impulses.

At the start of each injection impulse $t_p$, the transistor T1 as well as the transistor T2 blocks, so that the output terminal A1 receives via resistance R a positive potential corresponding to the positive edge of the impulse generated at output A1. In case of normal operation when the critical area ($t_{pmax}$), has not yet been reached the falling edge of the $t_p$ impulse switches on the transistor T2 the impulse at and the output A1 ends in synchronism with the $t_p$ impulse. If, however, the duration of the $t_p$ impulse is above a predetermined maximum time period, and thus reaches the critical or limiting area, then the monostable multivibrator becomes effective. At the start of each injection impulse transistor T1 blocks and capacitor C1 charges to a positive potential. The duration of the charging process is additionally dependent on the altitude dependent voltage supplied by the altimeter HG via the resistance $R_{HK}$. As soon as a predetermined positive potential relative to the non-inverting (+) input of the comparator is applied by capacitor C1 to the inverting input of the comparator K, the output of the comparator drops to a lower potential or earth potential regardless of whether or not the $t_p$ impulse is still present at transistor T2. The monostable multivibrator of the impulse generating circuit S therefore determines in advance the duration of the $t_{pmax}$ impulse and in addition renders this $t_{pmax}$ impulse dependent on the respective operational altitude. The extent of the altitude effect can be determined by dimensioning and/or adjusting the resistance $R_{HK}$.

It will be understood that each of the elements described above, or two or more together, may also find a useful application in other types of methods and arrangements for supplying a maximum amount of fuel differing from the types described above.

While the invention has been illustrated and described as embodied in a method and arrangement for supplying a maximum amount of fuel, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of limiting a quantity of fuel to be supplied to a combustion engine of a motor vehicle, comprising the steps of defining in dependency on load and rotary speed a first quantity of fuel to be supplied, determining air density of the surrounding air, determining in dependency on the air density and rotary speed a second quantity of fuel which is a limit for said first quantity, and limiting said first quantity of fuel to be supplied to the engine to said second quantity.

2. A method as defined in claim 1, wherein said determining step includes measuring an instantaneous altitude of a motor vehicle above sea level, said limiting step including reducing the first quantity of fuel to be supplied in correspondence with an increase of the measured instantaneous altitude.

3. A method as defined in claim 1 wherein said defining step is performed independently of the air mass flow in the engine.

4. An arrangement for limiting a quantity of fuel to be supplied to a combustion engine of a motor vehicle, comprising first means for defining in dependency on load and rotary speed, a first quantity of fuel to be supplied to the engine, means for determining air density of surrounding air, second means for defining in dependency on the determined air density, a second quantity of fuel; and means for limiting the first quantity of fuel to be supplied to the engine to said second quantity of fuel.

5. An arrangement as defined in claim 4, wherein said determining means includes means for measuring an instantaneous altitude of a motor vehicle above the sea level, said limiting means including means for reducing the first quantity of fuel to be supplied in correspondence with an increase of the measured instantaneous altitude.

6. An arrangement as defined in claim 5, wherein said first defining means includes a first circuit for generating an injection impulse of varying duration corresponding to the first quantity of fuel to be supplied, said measuring means including a second circuit for generating an air density impulse whose duration depends on the measured instantaneous altitude, and said limiting means combining said injection impulse with said air density impulse to generate an output injection impulse whose duration depends on the measured instantaneous altitude.

7. An arrangement as defined in claim 6, wherein the measuring means includes an altimeter generating a signal for cooperating with the second circuit so that the maximum amount of supplied fuel is reduced depending on the altitude of the motor vehicle above mean sea level.

* * * * *